US011505855B2

(12) United States Patent
Nagano et al.

(10) Patent No.: US 11,505,855 B2
(45) Date of Patent: Nov. 22, 2022

(54) HIGH-STRENGTH STEEL SHEET

(71) Applicant: NIPPON STEEL CORPORATION, Tokyo (JP)

(72) Inventors: Mai Nagano, Tokyo (JP); Koutarou Hayashi, Tokyo (JP); Akihiro Uenishi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 50 days.

(21) Appl. No.: 17/258,704

(22) PCT Filed: Jul. 26, 2019

(86) PCT No.: PCT/JP2019/029384

§ 371 (c)(1),
(2) Date: Jan. 7, 2021

(87) PCT Pub. No.: WO2020/022477

PCT Pub. Date: Jan. 30, 2020

(65) Prior Publication Data

US 2021/0269903 A1 Sep. 2, 2021

(30) Foreign Application Priority Data

Jul. 27, 2018 (JP) ..... JP2018-141226

(51) Int. Cl.

| | |
|---|---|
| ***C22C 38/38*** | (2006.01) |
| ***C22C 38/16*** | (2006.01) |
| ***C22C 38/14*** | (2006.01) |
| ***C22C 38/12*** | (2006.01) |
| ***C22C 38/08*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |
| ***C21D 9/46*** | (2006.01) |
| ***C21D 8/02*** | (2006.01) |
| ***C21D 6/00*** | (2006.01) |

(52) U.S. Cl.

CPC ..... *C22C 38/38* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0263* (2013.01); *C21D 9/46* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C21D 2211/001* (2013.01); *C21D 2211/008* (2013.01)

(58) Field of Classification Search
None
See application file for complete search history.

(56) References Cited

U.S. PATENT DOCUMENTS

2016/0002759 A1* 1/2016 Li ..... C22C 38/08 148/330
2016/0348207 A1 12/2016 Park

FOREIGN PATENT DOCUMENTS

| | | | |
|---|---|---|---|
| JP | 3-87320 | A | 4/1991 |
| JP | 3-180445 | A | 8/1991 |
| JP | 2007-308743 | A | 11/2007 |
| JP | 2008-144233 | A | 6/2008 |
| JP | 2017-504720 | A | 2/2017 |
| KR | 10-2006-0132378 | A | 12/2006 |

OTHER PUBLICATIONS

"Metallic materials-Tensile testing-Method of test at room temperature", JIS Z 2241, (2011), total of 23 pages.
"Specimen dimensions and procedure for cross tension testing resistance spot and embossed projection welded joints", JIS Z 3137, (1999), total of 8 pages.
Nakaoka et al., "Strength, Ductility and Aging Properties of Continuously-Annealed Dual-Phase High-Strength Sheet Steels", Formable HSLA and Dual-Phase Steels, Metall. Soc. of AIME, (1977), pp. 126-141.
Ono et al., "Welding technology", 51(3), (2003), pp. 77-82.
Satoh et al., "Hot Straining Embrittlement and Material Assessment of 50kg/mm$^2$ High Strength Steel", Journal of the Society of Naval Architects of Japan, 142, (1977), pp. 173-181.

* cited by examiner

*Primary Examiner* — Anthony M Liang
(74) *Attorney, Agent, or Firm* — Birch, Stewart, Kolasch & Birch, LLP

(57) ABSTRACT

What is provided is a high-strength steel sheet including, by mass %: C: 0.05% to 0.15%; Si: 1.5% or less; Mn: 2.00% to 5.00%; P: 0.100% or less; S: 0.010% or less; Al: 0.001% to 2.000%; N: 0.010% or less; and a remainder of Fe and impurities, in which Ceq defined by Ceq=C+Si/90+Mn/100+1.5P+3S is less than 0.21, the high-strength steel sheet contains martensite in an area ratio of 98% or more, and a residual structure is in an area ratio of 2% or less, a two-dimensional homogeneous dispersion ratio S defined by $S=Sy^2/Sx^2$ ($Sx^2$ is a dispersion value of Mn concentration profile data in a sheet width direction, and $Sy^2$ is a dispersion value of the Mn concentration profile data in a sheet thickness direction) is 0.85 or more and 1.20 or less, and a tensile strength is 1200 MPa or more.

7 Claims, No Drawings

HIGH-STRENGTH STEEL SHEET

TECHNICAL FIELD OF THE INVENTION

The present invention relates to a high-strength steel sheet, and particularly to a high-strength steel sheet which has a tensile strength of 1200 MPa or more, is suitable for a structural member of a vehicle and the like, which is mainly press-formed to be used, and is excellent in bake hardenability and weldability.

Priority is claimed on Japanese Patent Application No. 2018-141226, filed Jul. 27, 2018, the content of which is incorporated herein by reference.

RELATED ART

In recent years, for global environmental protection, there is a demand for an improvement in the fuel efficiency of a vehicle, and for a reduction in the weight of the vehicle body and securing safety, there is a demand for further high-strengthening in a vehicle steel sheet. In the case of high-strengthening of a steel sheet, the ductility generally decreases, so that it is difficult to perform cold press forming. Therefore, there is a demand for a material that is relatively soft and is likely to be formed during forming and has high strength after the forming, that is, a material having excellent bake hardenability.

The material having excellent bake hardenability mentioned here is a material having a large amount of bake hardening and a high strength after bake hardening.

The bake hardening is a strain aging phenomenon that occurs when interstitial elements (carbon or nitrogen) diffuse into dislocations formed by press forming (hereinafter, also referred to as "prestrain") during baking for coating at 150° C. to 200° C. and lock the dislocations.

As shown in Non-Patent Document 1, the amount of bake hardening depends on the amount of interstitial solid solution element, that is, the amount of solute carbon. Therefore, in martensite, which has a larger amount of solute carbon than ferrite, which has a small amount of solute carbon, the amount of bake hardening increases. In this regard, for example, Patent Document 1 discloses a high-strength steel sheet primarily containing bainite and martensite. In the high-strength steel sheet disclosed in Patent Document 1, a steel material is subjected to a predetermined treatment to increase a dislocation density and improve bake hardenability. Considering these factors, it is considered that even with the same martensite, the amount of bake hardening is increased by increasing the concentration of added carbon.

On the other hand, when too much carbon or alloying element is added, weldability generally deteriorates. Carbon equivalent (Ceq) is one of indexes of weldability. This is a method of estimating weldability from the proportions of elements contained in a steel sheet. For example, Ceq is defined by the following formula according to the JIS standard. Here, the amount (mass %) of each element is substituted into the symbol corresponding to the element in the formula.

$$Ceq=C+Si/24+Mn/6+Ni/40+Cr/5+Mo/4+V/14$$

However, it is said that the above formula is suitable for the evaluation of high carbon thick steel sheets used for building materials, but is not suitable for steel sheets for vehicles. Therefore, as shown in Non-Patent Document 2, Ono proposed Ceq represented by the following formula.

$$Ceq=C+Si/90+(Mn+Cr)/100+1.5P+3S$$

In general, the higher the Ceq, the more difficult the welding becomes. Therefore, in order to improve weldability, it is important to reduce the elements contained in the above formula. In a high-strength steel sheet for a vehicle in the related art, an upper limit is set for a C content, and the strength is supplemented with other alloying elements to secure weldability. Such a technique is disclosed in Patent Document 2, for example. That is, the weldability is secured by reducing the concentration of added carbon. It is also important to secure properties after welding. For example, in a structure including a martensite-austenite constituent (M-A constituent) in the primary phase, MA acts as an embrittlement phase and deteriorates toughness after welding because MA is a structure harder than the primary phase.

As described above, from the viewpoint of alloying elements, it is difficult to achieve both bake hardenability and weldability.

In addition, in the high-strength steel sheet described in Patent Document 1, as described above, the bake hardenability is improved not only by primarily including martensite and bainite but also by increasing the dislocation density. However, in general, steel having a high dislocation density causes thermal strain embrittlement as shown in Non-Patent Document 3, and thus has poor weldability.

On the other hand, in the invention described in Patent Document 3, weldability is secured by precipitating metal carbides with tempered martensite or bainite as the primary phase. However, in the invention described in Patent Document 3, since there is a tempering step, there is a problem that the amount of solute carbon is reduced and bake hardenability is deteriorated.

As described above, it is difficult to achieve both bake hardenability and weldability not only from the viewpoint of alloying elements but also from the viewpoint of dislocation density.

PRIOR ART DOCUMENT

Patent Document

[Patent Document 1] Japanese Unexamined Patent Application, First Publication No. 2008-144233

[Patent Document 2] Japanese Unexamined Patent Application, First Publication No. H3-180445

[Patent Document 3] Japanese Unexamined Patent Application, First Publication No. 2007-308743

Non-Patent Document

[Non-Patent Document 1] K. Nakaoka, et al., "Strength, Ductility and Aging Properties of Continuously-Annealed Dual-Phase High-Strength Sheet Steels", Formable HSLA and Dual-Phase Steels, Metall. Soc. of AIME, (1977) 126-141

[Non-Patent Document 2] Moriaki Ono, "Spot Weldability of High-Strength Thin Steel sheets for Vehicles", Welding Technology, 51(3) (2003) 77-82

[Non-patent document 3] Kunihiko Satoh, et al., Journal of the Society of Naval Architects of Japan, 142 (1977) 173-181

DISCLOSURE OF THE INVENTION

Problems to be Solved by the Invention

In order to meet the demand for further high-strengthening in the future, it is necessary to increase the carbon concentration in order to secure excellent bake hardenability. However, as a result, there is a problem that Ceq increases and weldability deteriorates. Also, from the viewpoint of dislocation density, it is difficult to achieve both bake hardenability and weldability.

Therefore, an object of the present invention is to provide a high-strength steel sheet having high bake hardenability and excellent weldability.

Means for Solving the Problem

The present inventors tried to secure the above-mentioned bake hardenability and weldability by the following two approaches.

(1) By appropriately controlling alloying elements, Ceq is suppressed and weldability is secured.

(2) By forming as-quenched martensite as a primary phase in order to secure an appropriate amount of solute carbon, bake hardenability is obtained.

However, this alone did not achieve a target tensile strength after bake hardening. Upon detailed investigation, from the fact that a deformation structure after bake hardening was non-uniform, the present inventors thought that non-uniform prestrain was applied due to a hardness difference in martensite and thus not all the martensite could be used for bake hardening, resulting in deterioration of bake hardenability. In addition, the present inventors found that this non-uniform hardness difference was caused by microsegregation of Mn. In general, microsegregation is a phenomenon in which the concentrations of alloying elements generated during solidification are non-uniformly distributed, and planes perpendicular to a sheet thickness direction are continuous in layers.

Therefore, the present inventors found that by controlling hot rolling to suppress microsegregation of Mn by forming a uniform structure, and allowing prestrain to be uniformly applied, bake hardenability is greatly improved. In addition, by forming the uniform structure, MA hardly occurred, and weldability was improved.

A high-strength steel sheet excellent in bake hardenability and weldability of the present invention which has achieved the above-mentioned object in this way is as follows.

(1) A high-strength steel sheet including, by mass %:

C: 0.05% to 0.15%;

Si: 1.5% or less;

Mn: 2.00% to 5.00%;

P: 0.100% or less;

S: 0.010% or less;

Al: 0.001% to 2.000%;

N: 0.010% or less; and a remainder of Fe and impurities, in which Ceq defined by Formula (1) is less than 0.21, the high-strength steel sheet contains martensite in an area ratio of 98% or more, and a residual structure is in an area ratio of 2% or less, a two-dimensional homogeneous dispersion ratio S defined by Formula (2) is 0.85 or more and 1.20 or less, and a tensile strength is 1200 MPa or more, $$Ceq=C+Si/90+(Mn+Cr)/100+1.5P+3S \quad \text{Formula (1)}$$

$$S=Sy^2/Sx^2 \quad \text{Formula (2)}$$

where an amount (mass %) of each element is substituted into a symbol corresponding to the element in Formula (1), 0 is substituted thereinto in a case where the element is not included, $S^2$ in Formula (2) is a dispersion value of Mn concentration profile data in a sheet width direction, and $Sy^2$ is a dispersion value of the Mn concentration profile data in a sheet thickness direction.

(2) The high-strength steel sheet according to (1), in which, in a case where the residual structure is present, the residual structure is formed of retained austenite.

(3) The high-strength steel sheet according to (1) or (2), further including, by mass %, one or two of:

Ti: 0.100% or less; and

Nb: 0.100% or less, in a total amount of 0.100% or less.

(4) The high-strength steel sheet according to any one of (1) to (3), further including, by mass %, one or two of:

Cu: 1.000% or less; and

Ni: 1.000% or less, in a total amount of 1.000% or less.

(5) The high-strength steel sheet according to any one of (1) to (4), further including, by mass %, one or two or more of:

W: 0.005% or less;

Ca: 0.005% or less;

Mg: 0.005% or less; and a rare earth metal (REM): 0.010% or less, in a total amount of 0.010% or less.

(6) The high-strength steel sheet according to any one of (1) to (5), further including, by mass %: B: 0.0030% or less.

(7) The high-strength steel sheet according to any one of (1) to (6), further including, by mass %: Cr: 1.000% or less.

Effects of the Invention

According to the present invention, it is possible to provide a high-strength steel sheet having excellent weldability and high bake hardenability by causing microsegregation of Mn to have a uniform structure in as-quenched martensite with controlled alloying elements, and specifically, a high-strength steel sheet with a tensile strength that reaches 1350 MPa after bake hardening. The high-strength steel sheet is subjected to high-strengthening by being baked during coating after press forming and is thus suitable in a structural field such as an automotive field.

EMBODIMENTS OF THE INVENTION

<High-Strength Steel Sheet>

A high-strength steel sheet according to an embodiment of the present invention includes, by mass %:

C: 0.05% to 0.15%;

Si: 1.5% or less;

Mn: 2.00% to 5.00%;

P: 0.100% or less;

S: 0.010% or less;

Al: 0.001% to 2.000%;

N: 0.010% or less; and a remainder of Fe and impurities, in which Ceq defined by Formula (1) is less than 0.21, the high-strength steel sheet contains martensite in an area ratio of 98% or more, and a residual structure is in an area ratio of 2% or less, a two-dimensional homogeneous dispersion ratio S defined by Formula (2) is 0.85 or more and 1.20 or less, and a tensile strength is 1200 MPa or more, $$Ceq=C+Si/90+(Mn+Cr)/100+1.5P+3S \quad \text{Formula (1)}$$

$$S=Sy^2/Sx^2 \quad \text{Formula (2)}$$

where the amount (mass %) of each element is substituted into a symbol corresponding to the element in Formula (1), 0 is substituted thereinto in a case where the element is not included, $Sx^2$ in Formula (2) is a dispersion value of Mn concentration profile data in a sheet width direction, and $Sy^2$ is a dispersion value of the Mn concentration profile data in a sheet thickness direction.

First, the chemical composition of the high-strength steel sheet according to the embodiment of the present invention and a slab used for the manufacturing thereof will be described. In the following description, "%", which is the unit of the amount of each element contained in the high-strength steel sheet and the slab, means "mass %" unless otherwise specified.

(C: 0.05% to 0.15%)

C has an action of increasing the amount of solute carbon and enhancing bake hardenability. In addition, C has an action of enhancing hardenability and increasing strength by being contained in a martensite structure. When the C content is less than 0.05%, a sufficient amount of solute carbon cannot be secured, and the amount of bake hardening decreases. Therefore, the C content is set to 0.05% or more, and preferably 0.08% or more. On the other hand, when the C content exceeds 0.15%, silicate having a low melting point is generated during welding, which affects the quality of weld seams. In addition, the strength is too high to secure formability. Therefore, the C content is set to 0.15% or less, preferably less than 0.13%, 0.12% or less, 0.11% or less, or 0.10% or less.

(Si: 1.5% or Less)

Si is a solid solution strengthening element and has a role of suppressing the precipitation of cementite, which is a factor that reduces strength. Therefore, Si may be contained in the high-strength steel sheet of the present invention. On the other hand, when the Si content exceeds 1.5%, the surface properties may deteriorate. Therefore, the Si content is set to 1.5% or less, and preferably 1.2% or less. Although the lower limit of the Si content is not particularly limited, since Si functions as a deoxidizing agent for molten steel, the Si content may be set to 0.01% or more.

(Mn: 2.00% to 5.00%)

Mn is an element that improves hardenability and is an element necessary for forming a martensite structure without limiting a cooling rate. In order to effectively exhibit this action, the Mn content is set to 2.00% or more, and preferably 2.50% or more. However, since excessive inclusion of Mn reduces low temperature toughness due to the precipitation of MnS, the Mn content is set to 5.00% or less, and preferably 4.50% or less.

(P: 0.100% or Less)

P is not an essential element, but is contained, for example, as an impurity in steel. From the viewpoint of weldability, the lower the P content, the better. In particular, when the P content exceeds 0.100%, a reduction in weldability is significant. Therefore, the P content is set to 0.100% or less, and preferably 0.030% or less. It takes a cost to reduce the P content, and a reduction in the P content to less than 0.0001% causes a significant increase in the cost. Therefore, the P content may be set to 0.0001% or more. Furthermore, since P contributes to an improvement in strength, the P content may be set to 0.0001% or more from such a viewpoint.

(S: 0.010% or Less)

S is not an essential element, but is contained, for example, as an impurity in steel. From the viewpoint of weldability, the lower the S content, the better. As the S content increases, the amount of MnS precipitated increases, and the low temperature toughness decreases. In particular, when the S content exceeds 0.010%, a reduction in the weldability and a reduction in the low temperature toughness are significant. Therefore, the S content is set to 0.010% or less, and preferably 0.003% or less. It takes a cost to reduce the S content, and a reduction in the S content to less than 0.0001% causes a significant increase in the cost. Therefore, the S content may be set to 0.0001% or more.

(Al: 0.001% to 2.000%)

Al has an effect on deoxidation. In order to effectively exhibit the above action, the Al content is set to 0.001% or more, and preferably 0.010% or more. On the other hand, when the Al content exceeds 2.000%, the weldability decreases or oxide-based inclusions are increased in amount, resulting in the deterioration of surface properties. Therefore, the Al content is set to 2.000% or less, and preferably 1.000% or less.

(N: 0.010% or Less)

N is not an essential element, but is contained, for example, as an impurity in steel. From the viewpoint of weldability, the lower the N content, the better. In particular, when the N content exceeds 0.010%, a reduction in the weldability is significant. Therefore, the N content is set to 0.010% or less, and preferably 0.006% or less. It takes a cost to reduce the N content, and a reduction in the N content to less than 0.0001% causes a significant increase in the cost. Therefore, the N content may be set to 0.0001% or more.

The basic composition of the high-strength steel sheet of the present invention and the slab used for the manufacturing thereof is as described above. Furthermore, the high-strength steel sheet of the present invention and the slab used for the manufacturing thereof may contain the following optional elements, as necessary.

(Ti: 0.100% or Less, and Nb: 0.100% or Less)

Ti and Nb contribute to an improvement in strength. Therefore, Ti, Nb, or any combination thereof may be contained. In order to sufficiently obtain this effect, the amount of Ti or Nb, or the total amount of a combination of the two is preferably set to 0.003% or more. On the other hand, when the amount of Ti or Nb or the total amount of the combination of the two exceeds 0.100%, it becomes difficult to perform hot rolling and cold rolling. Therefore, the Ti content, the Nb content, or the total amount of the combination of the two is set to 0.100% or less. That is, it is preferable that the limit range in the case of including each element alone is set to Ti: 0.003% to 0.100% and Nb: 0.003% to 0.100%, and the total amount thereof in the case of the combination thereof is also set to 0.003% to 0.100%.

(Cu: 1.000% or Less, and Ni: 1.000% or Less)

Cu and Ni contribute to an improvement in strength. Therefore, Cu, Ni, or a combination thereof may be contained. In order to sufficiently obtain this effect, the amount of Cu and Ni is preferably in a range of 0.005% to 1.000% in the case of including each element alone, and the total amount thereof in the case of the combination of the two preferably satisfies 0.005% or more and 1.000% or less. On the other hand, when the amount of Cu and Ni or the total amount in the case of the combination of the two exceeds 1.000%, the effect due to the above-mentioned action is saturated and causes an increase in the cost. Therefore, the upper limit of the amount of Cu and Ni, or the total amount in the case of the combination of the two is set to 1.000%. That is, it is preferable that Cu: 0.005% to 1.000% and Ni: 0.005% to 1.000% are set, and the total amount in the case of the combination thereof is 0.005% to 1.000%.

(W: 0.005% or Less, Ca: 0.005% or Less, Mg: 0.005% or Less, and REM: 0.010% or Less)

W, Ca, Mg, and REM contribute to the fine dispersion of inclusions and enhance toughness. Therefore, W, Ca, Mg, or REM or any combination thereof may be contained. In order to sufficiently obtain this effect, the total amount of W, Ca, Mg, and REM, or any combination of two or more thereof is preferably set to 0.0003% or more. On the other hand, when the total amount of W, Ca, Mg, and REM exceeds 0.010%, the surface properties deteriorate. Therefore, the total amount of W, Ca, Mg, and REM is set to 0.010% or less. That is, it is preferable that W: 0.005% or less, Ca: 0.005% or less, Mg: 0.005% or less, and REM: 0.010% or less are set, and the total amount of any two or more thereof is 0.0003% to 0.010%.

REM (rare earth metal) refers to a total of 17 elements including Sc, Y, and lanthanoids, and "REM content" means the total amount of these 17 elements. Lanthanoids are added industrially, for example, in the form of misch metal.

(B: 0.0030% or Less)

B is an element that improves hardenability and is an element useful for forming a martensite structure. B may be contained in 0.0001% (1 ppm) or more. However, when B is contained in more than 0.0030% (30 ppm), there are cases where excessive boron causes high temperature embrittlement and affects welding performance. Therefore, the B content is set to 0.0030% or less. The B content is preferably 0.0025% or less.

(Cr: 1.000% or Less)

Cr is an element that improves hardenability and is an element useful for forming a martensite structure. Cr is preferably contained in 0.005% or more. However, when Cr is contained in more than 1.000%, there are cases where the welding performance is affected. Therefore, the Cr content is set to 1.000% or less. The Cr content is preferably set to 0.500%.

In the high-strength steel sheet according to the present embodiment, the remainder other than the above elements includes Fe and impurities. Here, the impurities are elements that are incorporated in due to various factors in a manufacturing process, including raw materials such as ores and scraps, when industrially manufacturing the high-strength steel sheet, and are not intentionally added to the high-strength steel sheet according to the present embodiment.

(Ceq is Less Than 0.21)

The present embodiment is characterized in that Ceq represented by Formula (1) is set to be less than a predetermined numerical value in order to enhance weldability. Accordingly, weldability can be secured. In order to further enhance such an effect, a Ceq of less than 0.21 needs to be secured. Ceq is preferably 0.18 or less.

$$Ceq=C+Si/90+(Mn+Cr)/100+1.5P+3S \quad \text{Formula (1)}$$

Here, the amount (mass %) of each element is substituted into the corresponding element symbol in Formula (1), and 0 is substituted in a case where the element is not included.

Next, the structure of the high-strength steel sheet according to the embodiment of the present invention will be described. Hereinafter, structure requirements will be described, but % relating to a structure fraction means "area ratio".

(Martensite: 98% or More)

The present embodiment is characterized in that martensite is secured in an area ratio of 98% or more. Accordingly, a sufficient amount of solute carbon can be secured, and as a result, bake hardenability can be enhanced. In order to further enhance such an effect, it is necessary to secure 98% or more of martensite, and for example, 100% of martensite may be secured.

In the present invention, the area ratio of martensite is determined as follows. First, a sample is taken with a sheet thickness cross section perpendicular to a rolling direction of a steel sheet as an observed section, the observed section is polished, the structure thereof at a thickness ¼ position of the steel sheet is observed with a scanning electron microscope with an electron backscatter diffractometer (SEM-EBSD) at a magnification of 5,000-fold, the resultant is subjected to image analysis in a visual field of 100 μm×100 μm to measure the area ratio of martensite, and the average of values measured at any five or more visual fields is determined as the area ratio of martensite in the present invention.

(Residual Structure: 2% or Less)

According to the present invention, the residual structure other than martensite has an area ratio of 2% or less. In order to further enhance the bake hardenability of the high-strength steel sheet, the area ratio of the residual structure is preferably set to 0%. In a case where the residual structure is present, the residual structure can include any structure and is not particularly limited, but it is preferable that, for example, the residual structure includes retained austenite or the residual structure is formed of retained austenite. There are cases where the generation of a small amount of retained austenite is unavoidable depending on the composition of the steel and manufacturing method. However, such a small amount of retained austenite does not adversely affect the bake hardenability, and can also contribute to an improvement in ductility by a transformation induced plasticity (TRIP) effect when subjected to deformation. Therefore, the residual structure may contain retained austenite in an area ratio range of 2% or less. However, in order to further enhance the bake hardenability, the residual structure does not contain retained austenite and is preferably 0%.

In the present invention, the area ratio of retained austenite is determined by an X-ray diffraction measurement. Specifically, a portion from the surface of the steel sheet to the thickness ¼ position of the steel sheet is removed by mechanical polishing and chemical polishing, and the X-ray diffraction intensity at a depth ¼ position from the surface of the steel sheet is measured using MoKα radiation as a characteristic X-ray. Then, from the integrated intensity ratios between the diffraction peaks of (200) and (211) of a body-centered cubic lattice (bcc) phase and (200), (220), and (311) of a face-centered cubic lattice (fcc) phase, the area ratio of retained austenite is calculated by using the following formula.

$$S\gamma=(I_{200f}+I_{220f}+I_{311f})/(I_{200b}+I_{211b})\times 100$$

In the above formula, Sγ represents the area ratio of retained austenite, $I_{200f}$, $I_{220f}$, and $I_{311f}$ respectively represent the intensities of the diffraction peaks of (200), (220), and (311) of the fcc phase, and $I_{200h}$ and $I_{211h}$ respectively represent the intensities of the diffraction peaks of (200) and (211) of the bcc phase.

(Two-Dimensional Homogeneous Dispersion Ratio S is 0.85 or More and 1.20 or Less)

The two-dimensional homogeneous dispersion ratio is an index for evaluating microsegregation of alloying elements. The two-dimensional homogeneous dispersion ratio represented by S is measured as follows. The sheet width direction is indicated as an x direction, the sheet thickness direction is indicated as a y direction, the steel sheet is adjusted so that a surface having the rolling direction thereof as a normal direction (that is, a cross section in the thickness direction of the steel sheet) can be observed, the surface is subjected to mirror polishing, and in a range of 100 μm×100 μm in the center portion of the steel sheet in the cross section in the thickness direction of the steel sheet, Mn concentrations are measured at 200 points at intervals of 0.5 μm from one side toward the other side along the thickness direction (y direction) of the steel sheet by an electron probe microanalyzer (EPMA) device. In addition, along the direction (x direction) perpendicular to the thickness direction of the steel sheet measured, Mn concentrations are similarly measured at 200 points at intervals of 0.5 μm from one side toward the other side. The dispersion values $Sx^2$ and $Sy^2$ are obtained from the respective Mn concentration profiles in the x direction and the y direction. Using these values, S is calculated by Formula (2).

$$S=Sy^2/Sx^2 \quad \text{Formula (2)}$$

Here, $Sx^2$ is a dispersion value of Mn concentration profile data in the sheet width direction and is represented by $Sx^2=(1/200)\times\Sigma(A-A_i)^2$, and in the formula, A is the average value of Mn concentrations at 200 points in the x direction, and $A_i$ represents the i-th Mn concentration in the x direction (i=1 to 200). Similarly, $Sy^2$ is a dispersion value of Mn concentration profile data in the sheet thickness direction and is represented by $Sy^2=(1/200)\times\Sigma(B-B_i)^2$, and in the formula, B is the average value of Mn concentrations at 200 points in the y direction, and $B_i$ represents the i-th Mn concentration in the y direction (i=1 to 200).

The present embodiment is characterized in that the Mn concentration distribution has a uniform structure (for example, a checkered pattern structure) due to relaxation of microsegregation. When this is less than 0.85, it cannot be said that a sufficiently uniform structure is formed, and the bake hardenability is low. In addition, MA is generated and the weldability is not good. Therefore, S needs to be 0.85 or more. S is preferably 0.90 or more, and more preferably 0.95 or more. On the other hand, as described above, in a case where the microsegregation is not controlled, planes with a high Mn concentration and planes with a low Mn concentration are repeated in layers in the sheet thickness direction. It is important to homogenize the planes in the sheet thickness direction and the sheet width direction. On the contrary, when the planes with a high Mn concentration and planes with a low Mn concentration are repeated in layers in the sheet thickness direction, the planes are not homogenized. That is, the reciprocal of the lower limit of S becomes the upper limit Therefore, S is set to 1.20 or less. S is preferably 1.15 or less, and more preferably 1.10 or less.

Next, the mechanical properties of the present invention will be described.

(Tensile Strength: 1200 MPa or More)

According to the high-strength steel sheet of the present invention having the above composition and structure, it is possible to achieve high tensile strength, specifically, a tensile strength of 1200 MPa or more. Here, the tensile strength is set to 1200 MPa or more in order to meet the demand for a reduction in the weight of a vehicle body. The tensile strength is preferably 1300 MPa or more, and more preferably 1400 MPa or more.

According to the high-strength steel sheet of the present invention, it is possible to achieve excellent bake hardenability. More specifically, according to the high-strength steel sheet of the present invention, it is possible to achieve a amount of bake hardening BH such that a value obtained by subtracting the stress at the time of application of 2% prestrain from the stress when a test piece subjected to a heat treatment at 170° C. for 20 minutes is re-tensioned after the application of 2% prestrain is 130 MPa or more, and preferably 150 MPa or more. When the value of BH is less than 130 MPa, it is difficult to perform forming and the strength after bake hardening is low, so that it cannot be said excellent bake hardenability is achieved. In addition, according to the high-strength steel sheet of the present invention, after 2% prestrain is applied, it is possible to achieve a tensile strength BHTS after bake hardening such that the stress when the test piece subjected to a heat treatment at 170° C. for 20 minutes is re-tensioned is 1350 MPa or more, and preferably 1400 MPa or more. When the value of BHTS is less than 1350 MPa, the strength after bake hardening is similarly low, so that it cannot be said that excellent bake hardenability is achieved.

<Manufacturing Method of High-Strength Steel Sheet>

Next, a preferred manufacturing method of a high-strength steel sheet according to the present embodiment will be described.

The following description is intended to exemplify the characteristic method for manufacturing the high-strength steel sheet of the present invention, and is not intended to limit the high-strength steel sheet of the present invention to be manufactured by the manufacturing method described below.

The preferred manufacturing method of a high-strength steel sheet of the present invention is characterized by including:

forming a slab by casting a molten steel having the chemical composition described above;

rough rolling the slab in a temperature range of 1050° C. or higher and 1250° C. or lower, in which the rough rolling includes reverse rolling performed an even number of times, which is two passes or more and 16 passes or less, the reverse rolling having a rolling reduction of 30% or less per pass, the difference in the rolling reduction between two passes during one reciprocation is 20% or less, the rolling reduction of an even-numbered pass during one reciprocation is higher by 5% or more than the rolling reduction of an odd-numbered pass, and holding is performed for five seconds or longer after the rough rolling;

finish rolling the rough-rolled steel sheet in a temperature range of 850° C. or higher and 1050° C. or lower, in which the finish rolling is performed by four or more continuous rolling stands, the rolling reduction of the first stand is 15% or more, and the finish-rolled steel sheet is coiled in a temperature range of 400° C. or lower;

cold rolling the obtained hot-rolled steel sheet at a rolling reduction of 15% or more and 45% or less;

annealing, which includes heating the obtained cold-rolled steel sheet at an average heating rate of 10° C./sec or faster, holding the obtained steel sheet in a temperature range of $Ac_3$ or higher and 1000° C. or lower for 10 to 1000 seconds, and then cooling the obtained steel sheet to 70° C. or lower at an average cooling rate of 10° C./sec or faster; and skin pass rolling the obtained steel sheet at a rolling reduction of 0.5% or more and 2.5% or less. Hereinafter, each process will be described.

(Forming Slab)

First, a molten steel having the chemical composition of the high-strength steel sheet according to the present invention described above is cast to form a slab to be provided for rough rolling. The casting method may be an ordinary casting method, and a continuous casting method, an ingot-making method, or the like can be adopted. In terms of productivity, the continuous casting method is preferable.

(Rough Rolling)

Before the rough rolling, it is preferable to heat the slab to a solutionizing temperature range of 1000° C. or higher and 1300° C. or lower. A heating retention time is not particularly specified, but it is preferable to hold the heating temperature for 30 minutes or longer in order to cause the central part of the slab to achieve a predetermined temperature. The heating retention time is preferably 10 hours or shorter and more preferably five hours or shorter in order to suppress excessive scale loss. When the temperature of the slab after casting is 1050° C. or higher and 1250° C. or lower, the slab may be subjected to rough rolling as it is without being heated and held in the temperature range, and may be subjected to hot direct rolling or direct rolled.

Next, by performing reverse rolling on the slab as the rough rolling, a Mn segregation portion in the slab formed during solidification in forming the slab can have a uniform structure without being formed as a plate-like segregation portion elongated in one direction. The formation of a Mn concentration distribution having such a uniform structure will be described in more detail. First, in a section of a slab before starting rough rolling, which is cut perpendicularly to the surface, alloying elements such as Mn concentrated in a comb-like form can be observed. Specifically, in the cut section of the slab before the rough rolling, a plurality of portions where the alloying elements such as Mn are linearly concentrated are arranged substantially perpendicularly to the surface of the slab from both surfaces toward the inside of the slab.

On the other hand, in the rough rolling, the surface of the slab is elongated in a direction in which rolling proceeds in each rolling pass. The direction in which rolling proceeds is a direction in which the slab travels with respect to rolling rolls. As the surface of the slab is thus stretched in the direction in which rolling proceeds, the Mn segregation portion growing toward the inside from the surface of the slab is inclined in the direction in which the slab travels in each rolling pass. In other words, rolling has a function of slightly inclining the Mn segregation portion extending in a comb shape toward the inside of the slab in the direction in which rolling proceeds.

Here, in the case of so-called unidirectional rolling in which the direction in which the slab travels in each pass of the rough rolling is always the same direction, the inclination of the Mn segregation portion gradually increases in the same direction in each pass while the Mn segregation portion itself maintains a substantially straight state. Then, at the end of the rough rolling, the Mn segregation portion is in a posture substantially parallel to the surface of the slab while maintaining a substantially straight state, and flat microsegregation is formed.

On the other hand, in the case of reverse rolling in which the directions in which the slab travels in the respective passes of the rough rolling alternately become opposite directions, the Mn segregation portion inclined in a certain direction in the immediately preceding pass receives a force to be inclined in the reverse direction in the subsequent pass. In this case, the Mn segregation portion has a bent shape. Therefore, in the reverse rolling, passes alternately performed in opposite directions are repeatedly performed, whereby the Mn segregation portion has a zigzag shape that is alternately bent.

When a plurality of zigzag shapes that are alternately bent are arranged in this manner, plate-like microsegregation disappears, and a Mn concentration distribution that is uniformly intricate is formed. In a case where an ideally uniform Mn concentration distribution is formed, the Mn concentration distribution appears in a substantially checkered pattern. The "checkered pattern (Ichimatsu pattern)" is a kind of lattice pattern, and is a pattern in which substantially squares (or substantially rectangles) having different colors are alternately arranged. In the present invention, a structure in which the Mn concentration distribution appears in a checkered pattern is called a checkered pattern structure. By adopting a uniform structure in which the two-dimensional homogeneous dispersion ratio S is 0.85 or more and 1.20 or less, Mn is more likely to diffuse due to a heat treatment in a subsequent process, and a hot-rolled steel sheet having a more uniform Mn concentration can be obtained. In addition, since a uniformly intricate Mn concentration distribution is formed over the entire steel sheet by the above-mentioned reverse rolling, such a uniform structure is similarly formed not only in a sheet thickness cross section parallel to the rolling direction but also in a sheet thickness cross section with the rolling direction as the normal line.

When the rough rolling temperature range is lower than 1050° C., it becomes difficult to complete the rolling at 850° C. or higher in the final pass of the rough rolling, resulting in defective shape. Therefore, the rough rolling temperature range is preferably 1050° C. or higher. The rough rolling temperature range is more preferably 1100° C. or higher. When the rough rolling temperature range exceeds 1250° C., scale loss increases and there is concern that slab cracking may occur. Therefore, the rough rolling temperature range is preferably 1250° C. or lower.

When the rolling reduction per pass in the rough rolling exceeds 30%, the shear stress during the rolling increases, and the Mn segregation portion becomes non-uniform. Therefore, the rolling reduction per pass in the rough rolling is set to 30% or less. The smaller the rolling reduction, the smaller the shear strain at the time of rolling, and the uniform structure can be obtained. Therefore, the lower limit of the rolling reduction is not particularly specified, but is preferably 10% or more from the viewpoint of productivity.

In order to cause the Mn concentration distribution to have a uniform structure, reverse rolling is preferably performed in two or more passes, and more preferably four or more passes. However, when reverse rolling is performed in more than 16 passes, it becomes difficult to secure a sufficient finish rolling temperature. Therefore, reverse rolling is performed in 16 or less passes. Furthermore, it is desirable that passes of which the travelling directions are opposite to each other are performed the same number of times, that is, the total number of passes is an even number. However, in a general rough rolling line, the inlet side and the outlet side of the rough rolling are located on opposite sides with rolls therebetween. Therefore, the number of passes (rolling) in the direction from the inlet side to the outlet side of the rough rolling is larger by one. Then, in the last pass (rolling), the Mn segregation portion has a flat shape and is less likely to form a uniform structure. In a case where rough rolling is performed on such a hot rolling line, it is preferable that rolling is omitted by opening the rolls in the last pass.

In the reverse rolling, when there is a difference in the rolling reduction between two passes included in rolling of one reciprocation, a defective shape is likely to occur, and the Mn segregation portion becomes non-uniform, so that a uniform structure cannot be obtained. Therefore, during the rough rolling, the difference in the rolling reduction between two passes included in one reciprocation of the reverse rolling is set to 20% or less. The difference is preferably 10% or less.

As will be described later, although tandem multi-stage rolling in finish rolling is effective for refining a recrystallization structure, tandem rolling facilitates the formation of flat microsegregation. In order to utilize the tandem multi-stage rolling, it is necessary that the rolling reduction in even-numbered passes in the reverse rolling is larger than the rolling reduction in odd-numbered passes to control microsegregation formed in the subsequent tandem rolling. The effect becomes significant when the rolling reduction in the even-numbered pass (return path) is higher than the rolling reduction of the odd-numbered pass (forward path) by 5% or more in one reciprocation of the reverse rolling. Therefore, in one reciprocation of the reverse rolling, it is preferable that the rolling reduction of the even-numbered pass is higher than the rolling reduction of the odd-numbered pass by 5% or more.

In order to cause the intricate structure of Mn generated by the reverse rolling in the rough rolling to be uniform by austenite grain boundary migration, it is preferable that holding is performed between the rough rolling and the finish rolling for five seconds or longer.

(Finish Rolling)

After the reverse rolling in the rough rolling, in order to narrow the spacing of Mn segregation zones caused by secondary dendrite arms by increasing the rolling reduction of the tandem rolling in the finish rolling, the finish rolling is preferably performed by four or more continuous rolling stands. When the finish rolling temperature is lower than 850° C., recrystallization does not sufficiently occur, a structure elongated in the rolling direction is formed, and a plate-like structure due to the stretched structure is generated in a post process. Therefore, the finish rolling temperature is preferably 850° C. or higher. The finish rolling temperature is preferably 900° C. or higher. On the other hand, when the finish rolling temperature exceeds 1050° C., it becomes difficult to generate fine austenite recrystallized grains, Mn segregation at grain boundaries becomes difficult, and the Mn segregation zones are likely to be flat. Therefore, the finish rolling temperature is preferably 1050° C. or lower. As necessary, the steel sheet subjected to the rough rolling may be heated after the rough rolling and before the finish rolling at an appropriate temperature. Furthermore, when the rolling reduction of the first stand of the finish rolling is set to 15% or more, a large amount of recrystallized grains are generated, and Mn is likely to be uniformly dispersed by the subsequent grain boundary migration. As described above, by limiting not only the rough rolling but also the finish rolling, it is possible to suppress the flat Mn microsegregation. The "finish rolling temperature" means the surface temperature of the steel sheet from the start of finish rolling to the end of finish rolling. In a case where the finish rolling is performed so that the finish rolling temperature falls within the above range, the so-called finish rolling start temperature (the steel sheet temperature in the first pass of the finish rolling) and finish rolling end temperature (the steel sheet temperature in the last pass of the finish rolling) also fall within the range of the finish rolling temperature mentioned above.

When a coiling temperature exceeds 400° C., the surface properties are deteriorated due to internal oxidation. Therefore, the coiling temperature is preferably 400° C. or lower. When the steel sheet structure is a homogeneous structure of martensite or bainite, a homogeneous structure is likely to be formed by annealing. Therefore, the coiling temperature is more preferably 300° C. or lower.

(Cold Rolling)

The hot-rolled steel sheet obtained by the finish rolling is pickled and then cold-rolled to obtain a cold-rolled steel sheet. In order to maintain laths of martensite, the rolling reduction is preferably 15% or more and 45% or less. When the rolling reduction in the cold rolling exceeds 45%, fine laths of martensite cannot be maintained and Mn is less likely to segregate at the grain boundaries. Therefore, Mn segregation zones elongate in the direction perpendicular to the sheet thickness (that is, the sheet surface direction). In the Mn segregation zones in the form of flat layers, the dispersion of Mn is non-uniform, so that the two-dimensional homogeneous dispersion ratio of Mn becomes lower than the above specified value. The pickling may be ordinary pickling.

(Annealing)

The steel sheet obtained through the cold rolling is subjected to an annealing treatment. For heating at an annealing temperature, the temperature is raised at an average heating rate of 10° C./sec or faster, and the heating is held in a temperature range of $Ac_3$ or higher and 1000° C. or lower for 10 to 1000 seconds. This temperature range and annealing time are set for austenitic transformation of the entire area of the steel sheet. When the holding temperature exceeds 1000° C. or the annealing time exceeds 1000 seconds, the austenite grain size becomes coarse and martensite with a large lath width is formed, resulting in a decrease in toughness. Therefore, the annealing temperature is set to $Ac_3$ or higher and 1000° C. or lower, and the annealing time is set to 10 to 1000 seconds.

The $Ac_3$ point is calculated by the following formula. Into an element symbol in the following formula, the mass % of the corresponding element is substituted. 0 mass % is substituted into the elements not contained.

$$Ac_3=881-335\times C+22\times Si-24\times Mn-17\times Ni-1\times Cr-27\times Cu$$

After holding at the annealing temperature, cooling is performed at an average cooling rate of 10° C./sec or faster. In order to freeze the structure and cause the martensitic transformation to efficiently occur, the cooling rate may be fast. However, at a cooling rate of slower than 10° C./sec, martensite is not sufficiently generated, and the structure cannot be controlled into a desired structure. Therefore, the cooling rate is set to 10° C./sec or more.

A cooling stop temperature is set to 70° C. or lower. This is because as-quenched martensite is generated on the entire area by cooling. When cooling is stopped at higher than 70° C., there is a possibility that a structure other than martensite may be generated. In addition, even in a case where martensite appears, there are cases where precipitates such as spheroidized iron carbide appear due to self-tempering, and in such a case, the amount of solute carbon decreases and the bake hardenability decreases. Therefore, the cooling stop temperature is set to 70° C. or lower, and preferably 60° C. or lower.

(Skin Pass Rolling)

After the annealing, skin pass rolling (temper rolling) is performed. This is necessary for work hardening of soft martensite and uniform application of dislocations due to prestrain even in a case where there is a hardness difference in the martensite even if the structure is uniform. Furthermore, in a case where retained austenite remains, the skin pass rolling has a role of increasing the martensite fraction by causing martensitic transformation by deformation processing-induced transformation. This effect cannot be achieved by skin pass rolling at a rolling reduction of less than 0.5%. Therefore, the rolling reduction is set to 0.5% or more. However, the upper limit thereof is preferably set to 2.5% because controlling the sheet thickness is difficult. The rolling reduction is more preferably set to 1.0% or less.

In this manner, the high-strength steel sheet according to the embodiment of the present invention can be manufactured.

It should be noted that each of the above-described embodiments is merely an example of an embodiment for carrying out the present invention, and the technical scope of the present invention should not be construed as being limited by these embodiments. That is, the present invention can be implemented in various forms without departing from the technical idea or the main features thereof.

EXAMPLES

Next, examples of the present invention will be described. The conditions in the examples are one example of conditions adopted to confirm the feasibility and effects of the present invention, and the present invention is not limited to this one example of conditions. The present invention can adopt various conditions as long as the object of the present invention is achieved without departing from the gist of the present invention.

A slab having the chemical composition shown in Table 1 was manufactured, and the slab was heated to 1300° C. for one hour, and then subjected to rough rolling and finish rolling under the conditions shown in Table 2 to obtain a hot-rolled steel sheet. Thereafter, the hot-rolled steel sheet was pickled and cold-rolled at the rolling reduction shown in Table 2 to obtain a cold-rolled steel sheet. Subsequently, annealing and skin pass rolling were performed under the conditions shown in Table 2. In addition, each temperature shown in Table 2 is a surface temperature of the steel sheet. Furthermore, in Table 2, "difference in rolling reduction between passes in one reciprocation (return path−forward path)" indicates a difference in rolling reduction between two passes included in one reciprocating rolling in reverse rolling. In any of the examples, reverse rolling including a plurality of reciprocating passes was performed, and the difference in rolling reduction between the reciprocating passes was the same in all the reciprocating passes. For example, it is shown in the table that in Example No. 1, the "number of rough rolling passes" was 8, and the "difference in rolling reduction between passes in one reciprocation (return path−forward path)" was 5%. This means that in Example No. 1, four reciprocations of reverse rolling were performed, and the rolling reduction in the return path was larger than the rolling reduction in the forward path by 5% in all of the four reciprocations.

In Table 2, $Ac_3$ was calculated by the following formula. Into an element symbol in the following formula, the mass % of the corresponding element was substituted. 0 mass % is substituted into the elements not contained.

$$Ac_3=881-335\times C+22\times Si-24\times Mn-17\times Ni-1\times Cr-27\times Cu$$

TABLE 1

| Steel type | Chemical composition (mass %) | | | | | | | | | | | | | | | | | |
|---|---|---|---|---|---|---|---|---|---|---|---|---|---|---|---|---|---|---|
| | C | Si | Mn | P | S | Al | N | Ti | Nb | Cu | Cr | Ni | W | Ca | Mg | REM | B | Ceq |
| A | 0.13 | 1.0 | 3.00 | 0.012 | 0.004 | 0.020 | 0.003 | | | | | | | | | | | 0.20 |
| B | 0.15 | 1.0 | 2.40 | 0.009 | 0.002 | 0.020 | 0.003 | 0.030 | | | | | | | | | | 0.20 |
| C | 0.12 | 0.9 | 2.20 | 0.013 | **0.015** | 0.020 | 0.003 | | | | | | | | | | | **0.22** |
| D | 0.09 | 1.2 | 2.80 | 0.012 | 0.004 | 0.020 | 0.003 | | | 0.010 | | | | | | | | 0.16 |
| E | 0.09 | 1.0 | 2.60 | 0.015 | 0.004 | 0.020 | 0.003 | 0.005 | 0.005 | | | | | | | | | 0.16 |
| F | 0.07 | 1.0 | 2.90 | 0.012 | 0.007 | 0.020 | 0.003 | | | | | | | 0.003 | | | | 0.15 |
| G | **0.02** | 0.6 | 2.00 | 0.009 | 0.004 | 0.020 | 0.003 | 0.005 | | | | | | | | | | 0.07 |
| H | 0.10 | 1.5 | 2.50 | **0.120** | 0.004 | 0.020 | 0.003 | | | | | | | | | | | **0.33** |
| I | 0.10 | 1.4 | 2.50 | 0.010 | 0.003 | 0.020 | 0.003 | | | | 0.010 | | | | | | | 0.16 |
| J | 0.12 | 1.1 | 2.20 | 0.011 | 0.004 | 0.020 | 0.003 | | | | | | | | 0.004 | 0.009 | | 0.18 |
| K | 0.11 | 1.5 | **0.05** | 0.009 | 0.008 | 0.020 | 0.003 | | | | | | 0.005 | | | | | 0.16 |
| L | 0.10 | 1.0 | 2.90 | 0.010 | 0.006 | 0.020 | 0.003 | | | | | | | | | | | 0.17 |
| M | **0.24** | 1.0 | 2.50 | 0.013 | 0.004 | 0.020 | 0.003 | | | | | | | | | | | **0.31** |
| N | 0.14 | 1.0 | 2.50 | 0.011 | 0.004 | 0.020 | 0.003 | | | | | | | | | | 0.0019 | 0.20 |
| O | 0.13 | 0.8 | 2.20 | 0.020 | 0.004 | 0.020 | 0.003 | | | | | 0.005 | | | | | | 0.20 |
| P | 0.10 | 1.5 | 2.50 | 0.010 | 0.006 | 0.020 | 0.003 | | | | | | | | | | | 0.17 |
| Q | 0.13 | 0.8 | 2.60 | 0.010 | 0.004 | **3.000** | 0.003 | | | | | | | | | | | 0.19 |
| R | 0.13 | 0.8 | 2.50 | 0.010 | 0.004 | 0.020 | **0.015** | | | | | | | | | | | 0.19 |
| S | 0.13 | 1.0 | 3.50 | 0.020 | 0.008 | 0.020 | 0.003 | | | | | | | | | | | **0.23** |

Bold and underlined value is out of scope of the present invention.

Blank cell in the table indicates that the chemical composition corresponding thereto is not intendedly added.

TABLE 2-1

| No. | Steel type | Manufacturing conditions | | | | | | | | | | |
|---|---|---|---|---|---|---|---|---|---|---|---|---|
| | | Rough rolling | | | | | | Finish rolling | | | | |
| | | Number of rough rolling passes | Maximum reduction in rough rolling (%) | Rough rolling start temperature (° C.) | Difference in rolling reduction between passes in one reciprocation (return path − forward path) (%) | Rough rolling finish temperature (° C.) | Duration between rough rolling and finish rolling (second) | Hot rolling stands (times) | Finish rolling start temperature (° C.) | Rolling reduction of first stand (%) | Finish rolling finish temperature (° C.) | Coiling temperature (° C.) |
| 1 | A | 8 | 25 | 1200 | 5 | 1050 | 7 | 4 | 1000 | 20 | 900 | 240 |
| 2 | A | 8 | 30 | 1200 | 5 | 1050 | 7 | 4 | 1000 | 20 | 900 | 230 |
| 3 | B | 8 | 30 | 1200 | 5 | 1050 | 7 | 4 | 1000 | 20 | 900 | 250 |

TABLE 2-1-continued

| | | Manufacturing conditions | | | | | | | | | | |
|---|---|---|---|---|---|---|---|---|---|---|---|---|
| | | Rough rolling | | | | | | Finish rolling | | | | |
| No. | Steel type | Number of rough rolling passes | Maximum reduction in rough rolling (%) | Rough rolling start temperature (° C.) | Difference in rolling reduction between passes in one reciprocation (return path − forward path) (%) | Rough rolling finish temperature (° C.) | Duration between rough rolling and finish rolling (second) | Hot rolling stands (times) | Finish rolling start temperature (° C.) | Rolling reduction of first stand (%) | Finish rolling finish temperature (° C.) | Coiling temperature (° C.) |
| 4 | C | 8 | 30 | 1200 | 5 | 1050 | 7 | 4 | 1000 | 20 | 900 | 270 |
| 5 | D | 8 | 30 | 1200 | 5 | 1050 | 7 | 4 | 1000 | 20 | 900 | 230 |
| 6 | E | 8 | 25 | 1200 | 5 | 1050 | 7 | 4 | 1000 | 20 | 850 | 250 |
| 7 | E | 8 | 25 | 1200 | 5 | 1050 | 7 | 4 | 1000 | 20 | 900 | 300 |
| 8 | E | 8 | 30 | 1200 | 5 | 1050 | 7 | 4 | 1000 | 20 | 900 | 200 |
| 9 | F | 8 | 30 | 1200 | 5 | 1050 | 7 | 4 | 1000 | 20 | 900 | 200 |
| 10 | F | 8 | 30 | 1200 | 5 | 1050 | 7 | 4 | 1000 | 20 | 900 | 200 |
| 11 | G | 8 | 30 | 1200 | 5 | 1050 | 7 | 4 | 1000 | 20 | 900 | 250 |
| 12 | H | 8 | 30 | 1200 | 5 | 1050 | 7 | 4 | 1000 | 20 | 850 | 200 |
| 13 | I | 8 | 25 | 1200 | 5 | 1050 | 7 | 4 | 1000 | 20 | 900 | 230 |
| 14 | I | 8 | 30 | 1200 | **25** | 1050 | 7 | 4 | 1000 | 20 | 900 | 230 |
| 15 | I | 8 | 25 | 1200 | **−10** | 1050 | 7 | 4 | 1000 | 20 | 900 | 230 |
| 16 | J | 8 | 30 | 1200 | 5 | 1050 | 7 | 4 | 1000 | 20 | 900 | 250 |
| 17 | J | **13** | 30 | 1200 | 5 | 1050 | 7 | 4 | 1000 | 20 | 900 | 220 |
| 18 | J | 8 | 30 | 1200 | 5 | 1050 | 7 | 4 | 1000 | 20 | 900 | 240 |
| 19 | K | 8 | 30 | 1200 | 5 | 1050 | 7 | 4 | 1000 | 20 | 900 | 180 |
| 20 | L | 8 | 30 | 1200 | 5 | 1050 | 7 | 4 | 1000 | 20 | 900 | 200 |
| 21 | L | 8 | **45** | 1200 | 5 | 1050 | 7 | 4 | 1000 | 20 | 900 | 200 |
| 22 | L | 8 | 30 | 1200 | 5 | 1050 | **2** | 4 | 1000 | 20 | 900 | 200 |
| 23 | M | 8 | 30 | 1200 | 5 | 1050 | 7 | 4 | 1000 | 20 | 900 | 180 |
| 24 | N | 8 | 30 | 1200 | 5 | 1050 | 7 | 4 | 1000 | 20 | 850 | 190 |
| 25 | N | 8 | 30 | 1200 | 5 | 1050 | 7 | **2** | 1000 | 20 | 850 | 190 |
| 26 | N | 8 | 30 | 1200 | 5 | 1050 | 7 | 4 | 1000 | 20 | 850 | 190 |
| 27 | O | 8 | 30 | 1200 | 5 | 1050 | 7 | 4 | 1000 | 20 | 900 | 210 |
| 28 | P | 8 | 30 | 1200 | 5 | 1050 | 7 | 4 | 1000 | 20 | 900 | 200 |
| 29 | P | 8 | 30 | 1200 | 5 | 1050 | 7 | 4 | 1000 | **10** | 900 | 200 |
| 30 | P | 8 | 30 | 1200 | 5 | 1150 | 12 | 4 | **1150** | 20 | 900 | 200 |
| 31 | Q | 8 | 25 | 1200 | 5 | 1050 | 7 | 4 | 1000 | 20 | 900 | 210 |
| 32 | R | 8 | 30 | 1200 | 5 | 1050 | 7 | 4 | 1000 | 20 | 900 | 270 |
| 33 | S | 8 | 30 | 1200 | 5 | 1050 | 7 | 4 | 1000 | 20 | 900 | 270 |

Bold and underlined value is out of the preferred range.

TABLE 2-2

| | | Manufacturing conditions | | | | | | |
|---|---|---|---|---|---|---|---|---|
| | | Annealing | | | | | | |
| No. | Cold rolling Rolling reduction (%) | Ac3(° C.) | Average heating rate (° C./s) | Annealing temperature (° C.) | Annealing time (Second) | Average cooling rate (° C./s) | Cooling stop rolling temperature (° C.) | Skin pass rolling Rolling reduction (%) |
| 1 | 35 | 799 | 20 | 900 | 300 | 100 | 45 | 0.5 |
| 2 | 30 | 799 | 20 | 850 | 200 | 100 | 40 | **None** |
| 3 | 30 | 795 | 20 | 850 | 200 | 100 | 50 | 0.5 |
| 4 | 30 | 808 | 20 | 900 | 200 | 100 | 45 | 0.5 |
| 5 | 40 | 810 | 20 | 900 | 200 | 100 | 45 | 0.5 |
| 6 | 35 | 810 | 20 | 900 | 200 | 100 | 45 | 0.5 |
| 7 | 30 | 810 | 20 | **750** | 200 | 100 | 50 | 0.5 |
| 8 | 30 | 810 | 20 | 850 | **2** | 100 | 50 | 0.5 |
| 9 | 30 | 810 | 20 | 900 | 200 | 50 | 45 | 0.5 |
| 10 | 40 | 810 | 20 | 900 | 200 | **1** | 40 | 0.5 |
| 11 | 45 | 840 | 20 | 900 | 200 | 50 | 50 | 0.5 |
| 12 | 30 | 827 | 20 | 900 | 200 | 50 | 45 | 0.5 |
| 13 | 40 | 827 | 20 | 900 | 200 | 50 | 50 | 0.5 |
| 14 | 40 | 827 | 20 | 900 | 200 | 50 | 45 | 0.5 |
| 15 | 40 | 827 | 20 | 900 | 200 | 50 | 50 | 0.5 |
| 16 | 40 | 812 | 20 | 900 | 200 | 70 | 50 | 0.5 |
| 17 | 40 | 812 | 20 | 900 | 200 | 50 | 45 | 0.5 |

TABLE 2-2-continued

| Manufacturing conditions | | | | | | | | |
|---|---|---|---|---|---|---|---|---|
| | | Annealing | | | | | | |
| No. | Cold rolling Rolling reduction (%) | Ac3(° C.) | Average heating rate (° C./s) | Annealing temperature (° C.) | Annealing time (Second) | Average cooling rate (° C./s) | Cooling stop rolling temperature (° C.) | Skin pass rolling Rolling reduction (%) |
| 18 | 40 | 812 | 20 | 850 | 200 | 50 | **350** | 0.5 |
| 19 | 40 | 876 | 20 | 880 | 200 | 100 | 45 | 0.5 |
| 20 | 40 | 800 | 20 | 900 | 300 | 50 | 40 | 0.5 |
| 21 | 40 | 800 | 20 | 900 | 300 | 100 | 45 | 0.5 |
| 22 | 35 | 800 | 20 | 900 | 300 | 50 | 40 | 0.5 |
| 23 | 40 | 763 | 20 | 900 | 300 | 50 | 45 | 0.5 |
| 24 | 45 | 796 | 20 | 850 | 200 | 50 | 45 | 0.5 |
| 25 | 45 | 796 | 20 | 850 | 200 | 50 | 45 | 0.5 |
| 26 | **65** | 796 | 20 | 850 | 200 | 50 | 45 | 0.5 |
| 27 | 40 | 802 | 20 | 900 | 200 | 200 | 40 | 0.5 |
| 28 | 45 | 832 | 20 | 880 | 200 | 100 | 50 | 0.5 |
| 29 | 45 | 832 | 20 | 880 | 200 | 100 | 50 | 0.5 |
| 30 | 45 | 832 | 20 | 880 | 200 | 100 | 50 | 0.5 |
| 31 | 40 | 793 | 20 | 900 | 200 | 100 | 55 | 0.5 |
| 32 | 35 | 795 | 20 | 850 | 200 | 50 | 45 | 0.5 |
| 33 | 40 | 775 | 20 | 850 | 200 | 50 | 45 | 0.5 |

Bold and underlined value is out of the preferred range

The area ratios of martensite and retained austenite were obtained for the obtained cold-rolled steel sheet by SEM-EBSD and an X-ray diffraction method.

In particular, the area ratio of martensite was determined as follows. First, a sample was taken with a sheet thickness cross section perpendicular to the rolling direction of the steel sheet as an observed section, the observed section was polished, the structure thereof at a thickness ¼ position of the steel sheet was observed with SEM-EBSD at a magnification of 5,000-fold, the resultant was subjected to image analysis in a visual field of 100 μm×100 μm to measure the area ratio of martensite, and the average of values measured at any five visual fields was determined as the area ratio of martensite. The area ratio of retained austenite was determined by an X-ray diffraction measurement. Specifically, a portion from the surface of the steel sheet to the thickness ¼ position of the steel sheet was removed by mechanical polishing and chemical polishing, and the X-ray diffraction intensity at a depth ¼ position from the surface of the steel sheet was measured using MoKα radiation as a characteristic X-ray. Then, from the integrated intensity ratios between the diffraction peaks of (200) and (211) of a body-centered cubic lattice (bcc) phase and (200), (220), and (311) of a face-centered cubic lattice (fcc) phase, the area ratio of retained austenite was calculated by using the following formula.

$$S\gamma=(I_{200f}+I_{220f}+I_{311f})/(I_{200b}+I_{211b})\times 100$$

In the above formula, Sγ represents the area ratio of retained austenite, $I_{200f}$, $I_{220f}$, and $I_{311f}$ respectively represent the intensities of the diffraction peaks of (200), (220), and (311) of the fcc phase, and $I_{200b}$ and $I_{211b}$ respectively represent the intensities of the diffraction peaks of (200) and (211) of the bcc phase.

In addition, the two-dimensional homogeneous dispersion ratio represented by S was obtained by an EMPA device.

Furthermore, the tensile strength TS, fracture elongation EL, amount of bake hardening BH, and tensile strength BHTS after bake hardening of the obtained cold-rolled steel sheet were measured. In the measurement of the tensile strength TS, fracture elongation EL, amount of bake hardening BH, and tensile strength BHTS after bake hardening, JIS No. 5 tensile test pieces whose longitudinal direction was perpendicular to the rolling direction were taken, and a tensile test was conducted according to JIS Z 2241. The amount of bake hardening BH is a value obtained by subtracting the stress at the time of application of 2% prestrain from the stress when a test piece subjected to a heat treatment at 170° C. for 20 minutes is re-tensioned after the application of 2% prestrain. The tensile strength BHTS after bake hardening is the stress when the test piece subjected to the heat treatment at 170° C. for 20 minutes after the application of 2% prestrain is re-tensioned. In order to satisfy the demand for a reduction in the weight of a vehicle body, the tensile strength is 1200 MPa or more, preferably 1300 MPa or more, and more preferably 1400 MPa or more. Furthermore, the elongation is preferably 5% or more for facilitating forming. In addition, regarding BH, with a BH of less than 130 MPa, it is difficult to perform forming and the strength after forming becomes low. Therefore, a BH of 130 MPa or more is required to provide excellent bake hardenability. The BH is more preferably 150 MPa or more. Regarding BHTS, a BHTS of 1350 MPa or more is required to improve collision performance by bake hardening. The BHTS is more preferably 1400 MPa or more.

As an evaluation of weldability, a test piece was taken according to JIS Z 3137, the same steel sheets were spot-welded, and a cross tensile test was conducted. Specifically, when a cross tensile test was conducted on a welding material under the condition that a nugget diameter became 6 mm by changing a current value with an electrode DR6 mm-40R, a welding time of 15 cycles/60 Hz, and a welding pressure of 400 kgf, a case in which fracture occurred at the base metal was determined as good, and a case in which fracture occurred at the nugget was determined as bad.

TABLE 3

| Mechanical property and structure | | | | | | | | | |
|---|---|---|---|---|---|---|---|---|---|
| | Mechanical property values | | | | | Steel structure | | | |
| Example No. | TS (MPa) | EL (%) | BH (MPa) | BHTS (MPa) | Weldability | Area ratio of martensite (%) | Area ratio of residual γ (%) | Two-dimensional homogeneous dispersion ratio S | Remarks |
| 1 | 1351 | 7.3 | 153 | 1449 | GOOD | 99 | 1 | 1.06 | Example |
| 2 | 1346 | 7.5 | **120** | 1401 | GOOD | **97** | **3** | 0.98 | Comparative Example |
| 3 | 1259 | 9.0 | 145 | 1376 | GOOD | 99 | 1 | 1.01 | Example |
| 4 | 1345 | 7.4 | 161 | 1443 | **BAD** | 100 | 0 | 0.97 | Comparative Example |
| 5 | 1299 | 8.6 | 151 | 1366 | GOOD | 100 | 0 | 1.02 | Example |
| 6 | 1279 | 8.8 | 148 | 1352 | GOOD | 99 | 1 | 0.88 | Example |
| 7 | **441** | 30.2 | **64** | **451** | GOOD | **45** | 0 | 0.95 | Comparative Example |
| 8 | **1040** | 18.5 | **95** | **1089** | GOOD | **65** | 0 | 0.95 | Comparative Example |
| 9 | 1254 | 8.8 | 159 | 1389 | GOOD | 100 | 0 | 1.04 | Example |
| 10 | **989** | 11.1 | **92** | **1072** | GOOD | **64** | 0 | 1.03 | Comparative Example |
| 11 | **781** | 13.4 | **68** | **825** | GOOD | 100 | 0 | 0.98 | Comparative Example |
| 12 | 1304 | 7.9 | 147 | 1496 | **BAD** | 100 | 0 | 0.98 | Comparative Example |
| 13 | 1376 | 7.6 | 156 | 1489 | GOOD | 99 | 1 | 1.02 | Example |
| 14 | 1372 | 7.5 | **121** | 1444 | **BAD** | 99 | 1 | **0.76** | Comparative Example |
| 15 | 1372 | 7.7 | **122** | 1477 | **BAD** | 99 | 1 | **0.75** | Comparative Example |
| 16 | 1322 | 7.8 | 155 | 1442 | GOOD | 98 | 2 | 1.00 | Example |
| 17 | 1319 | 7.8 | **101** | 1420 | **BAD** | 99 | 1 | **0.72** | Comparative Example |
| 18 | 1251 | 9.1 | **111** | 1378 | GOOD | **97** | **3** | 1.03 | Comparative Example |
| 19 | **590** | 20.1 | **71** | **601** | GOOD | **11** | 0 | 1.02 | Comparative Example |
| 20 | 1363 | 7.3 | 156 | 1501 | GOOD | 99 | 1 | 1.09 | Example |
| 21 | 1352 | 7.3 | **121** | 1471 | **BAD** | 99 | 1 | **0.75** | Comparative Example |
| 22 | 1359 | 7.5 | **120** | 1481 | **BAD** | 99 | 1 | **0.71** | Comparative Example |
| 23 | 1557 | **4.0** | **111** | 1670 | **BAD** | **92** | **8** | 0.99 | Comparative Example |
| 24 | 1289 | 8.4 | 149 | 1358 | GOOD | 100 | 0 | 0.98 | Example |
| 25 | 1287 | 8.3 | **125** | **1331** | **BAD** | 100 | 0 | **0.71** | Comparative Example |
| 26 | 1281 | 8.6 | **122** | **1328** | **BAD** | 100 | 0 | **0.72** | Comparative Example |
| 27 | 1354 | 7.7 | 151 | 1477 | GOOD | 100 | 0 | 0.92 | Example |
| 28 | 1326 | 7.8 | 148 | 1489 | GOOD | 100 | 0 | 1.07 | Example |
| 29 | 1325 | 7.9 | **122** | 1422 | **BAD** | 100 | 0 | **0.74** | Comparative Example |
| 30 | 1330 | 7.9 | **124** | 1423 | **BAD** | 100 | 0 | **0.72** | Comparative Example |
| 31 | 1311 | 7.9 | 152 | 1441 | **BAD** | 100 | 0 | 1.06 | Comparative Example |
| 32 | 1299 | 8.2 | 148 | 1427 | **BAD** | 99 | 1 | 0.98 | Comparative Example |
| 33 | 1269 | 8.4 | 149 | 1374 | **BAD** | 99 | 1 | 1.05 | Comparative Example |

Bold and underlined value is out of scope of the present invention, or the preferred range.

[Evaluation Results]

As shown in Table 3, in Examples 1, 3, 5, 6, 9, 13, 16, 20, 24, 27 and 28, excellent tensile strength, bake hardenability, and weldability could be obtained. In all the cases, the tensile strength was 1200 MPa or more, the BH was 130 MPa or more, the BHTS was 1350 MPa or more, and the base metal had fractured in the cross tensile test, so that it was shown that the strength was high, the bake hardenability was excellent, and the weldability was also excellent.

On the other hand, in Comparative Example 2, since there was no skin pass rolling, retained austenite remained and the BH was low. In Comparative Example 4, since the S content was too high, and the Ceq was high and weldability was poor. In Comparative Example 7, since the annealing temperature was too low, a ferrite structure appeared, a sufficient martensite structure was not obtained, and as a result, the TS, BH, and BHTS were low. In Comparative Example 8, since the annealing time was too short, the martensite structure was formed not over the entire area, and the TS, BH, and BHTS were similarly low. In Comparative Example 10, since the average cooling rate in the annealing was too slow, the martensite structure was formed not over the entire area, and the TS, BH, and BHTS were low. In Comparative Example 11, since the C content was too small, the amount of solute carbon decreased, and the TS, BH, and BHTS were low. In Comparative Example 12, since the P content was too large, the weldability was poor. In Comparative Example 14, since the difference in the rolling reduction between the two passes during one reciprocation in the rough rolling was large, a structure with a uniform Mn concentration distribution was not formed, the BH was low, and the weldability was poor. In Comparative Example 15, since the rolling reduction in the even-numbered pass during one reciprocation in the rough rolling was smaller than the rolling reduction in the odd-numbered pass, a structure with a uniform Mn concentration distribution was not formed, the BH was low, and the weldability was poor. In Comparative Example 17, since the number of passes of reverse rolling in the rough rolling was an odd number, a structure with a uniform Mn concentration distribution was not formed, the BH was low, and the weldability was poor.

In Comparative Example 18, since the cooling stop temperature in the annealing was high, a structure other than martensite appeared, and furthermore, iron carbide was precipitated, resulting in a reduction in the amount of solute carbon. Therefore, the BH was low. In Comparative Example 19, since the Mn content was too low, the TS, BH, and BHTS were low. In Comparative Example 21, since the rolling reduction of the reverse rolling in the rough rolling was high, a structure with a uniform Mn concentration distribution was not formed, the BH was low, and the weldability was poor. In Comparative Example 22, the time from the rough rolling to the finish rolling was too short, the Mn concentration distribution became flat, the BH was low, and the weldability was poor. In Comparative Example 23, since the C content was too high, the area ratio of retained austenite (γ) was high, the BH was low, the Ceq was high, and the weldability was poor. In Comparative Example 25, since the number of rolling stands for the finish rolling was small, the Mn concentration distribution became flat, the BH and BHTS were low, and the weldability was poor. In Comparative Example 26, the cold rolling ratio was high, the Mn concentration distribution was elongated in the direction perpendicular to the sheet thickness and became flat, BH and BHTS were low, and the weldability was poor. In Comparative Example 29, the rolling reduction of the first stand in the finish rolling was small, the Mn concentration distribution became flat, the BH was low, and the weldability was poor. In Comparative Example 30, since the finish rolling temperature (finish rolling start temperature in Table 2) was too high, the Mn concentration distribution became flat, the BH was low, and the weldability was poor. In Comparative Example 31, since the Al content was too large, the weldability was poor. In Comparative Example 32, since the N content was too large, the weldability was poor. In Comparative Example 33, since the Ceq was too high, the weldability was poor.

INDUSTRIAL APPLICABILITY

The high-strength steel sheet having excellent bake hardenability and weldability according to the present invention can be used as an original sheet of a structural material for a vehicle, particularly in an automotive industry field.

What is claimed is:

1. A high-strength steel sheet comprising, by mass %:
C: 0.05% to 0.15%;
Si: 1.5% or less;
Mn: 2.00% to 5.00%;
P: 0.100% or less;
S: 0.010% or less;
Al: 0.001% to 2.000%;
N: 0.010% or less; and
a remainder of Fe and impurities,
wherein Ceq defined by Formula (1) is less than 0.21,
the high-strength steel sheet contains martensite in an area ratio of 98% or more, and a residual structure is in an area ratio of 2% or less,
a two-dimensional homogeneous dispersion ratio S defined by Formula (2) is 0.85 or more and 1.20 or less, and
a tensile strength is 1200 MPa or more, $$Ceq=C+Si/90+(Mn+Cr)/100+1.5P+3S \quad \text{Formula (1)}$$

$$S=Sy^2/Sx^2 \quad \text{Formula (2)}$$

wherein an amount, in mass %, of each element is substituted into a symbol corresponding to the element in Formula (1), 0 is substituted thereinto in a case where the element is not included, $Sx^2$ in Formula (2) is a dispersion value of Mn concentration profile data in a sheet width direction and is represented by $Sx^2=(1/200)\times\Sigma(A-A_i)^2$, wherein A is an average value of Mn concentrations at 200 points in the sheet width direction, and Ai represents an i-th Mn concentration in the sheet width direction, where i=1 to 200, and $Sy^2$ is a dispersion value of Mn concentration profile data in a sheet thickness direction and is represented by $Sy^2=(1/200)\times\Sigma(B-B_i)^2$, wherein B is an average value of Mn concentrations at 200 points in the sheet thickness direction, and Bi represents an i-th Mn concentration in the sheet thickness direction, where i=1 to 200.

2. The high-strength steel sheet according to claim 1, wherein, in a case where the residual structure is present, the residual structure is formed of retained austenite.

3. The high-strength steel sheet according to claim 1, further comprising, by mass %, one or two of:
Ti: 0.100% or less; and
Nb: 0.100% or less, in a total amount of 0.100% or less.

4. The high-strength steel sheet according to claim 1, further comprising, by mass %, one or two of:
Cu: 1.000% or less; and
Ni: 1.000% or less, in a total amount of 1.000% or less.

5. The high-strength steel sheet according to claim 1, further comprising, by mass %, one or two or more of:
W: 0.005% or less;
Ca: 0.005% or less;
Mg: 0.005% or less; and
a rare earth metal (REM): 0.010% or less, in a total amount of 0.010% or less.

6. The high-strength steel sheet according to claim 1, further comprising, by mass %:
B: 0.0030% or less.

7. The high-strength steel sheet according to claim 1, further comprising, by mass %:
Cr: 1.000% or less.

* * * * *